US011462861B2

(12) United States Patent
Droesbeke et al.

(10) Patent No.: US 11,462,861 B2
(45) Date of Patent: Oct. 4, 2022

(54) ELECTRICAL SHIELDING MEMBER FOR A NETWORK CONNECTOR

(71) Applicant: APTIV TECHNOLOGIES LIMITED, St. Michael (BB)

(72) Inventors: Gert Droesbeke, Erkrath (DE); Christian Staab, Remscheid (DE); Andreas Kurpiela, Cologne (DE)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/970,303

(22) PCT Filed: Feb. 4, 2019

(86) PCT No.: PCT/EP2019/052643
§ 371 (c)(1),
(2) Date: Aug. 14, 2020

(87) PCT Pub. No.: WO2019/158384
PCT Pub. Date: Aug. 22, 2019

(65) Prior Publication Data

US 2021/0119385 A1 Apr. 22, 2021

(30) Foreign Application Priority Data

Feb. 16, 2018 (EP) ..... 18157248

(51) Int. Cl.
*H01R 13/6581* (2011.01)
*H01R 4/18* (2006.01)
(Continued)

(52) U.S. Cl.
CPC ..... *H01R 13/6581* (2013.01); *H01R 4/184* (2013.01); *H01R 13/506* (2013.01);
(Continued)

(58) Field of Classification Search
None
See application file for complete search history.

(56) References Cited

U.S. PATENT DOCUMENTS 4,010,538 A 3/1977 OKeefe et al.
4,954,097 A * 9/1990 Sekiguchi ..... H01R 13/627 439/352

(Continued)

FOREIGN PATENT DOCUMENTS

EP 2884592 A1 6/2015

OTHER PUBLICATIONS

Chinese Office Action for CN Application No. 201980013745.2, dated May 31, 2021, 6 pages.

(Continued)

*Primary Examiner* — Oscar C Jimenez
(74) *Attorney, Agent, or Firm* — Billion & Armitage

(57) ABSTRACT

The present invention relates to an electrical shielding member that includes a receiving portion for receiving a cable end of a shielded cable at least partially, wherein the receiving portion is adapted to be in contact with a shielding of the cable, and wherein the receiving portion comprises at least one coupling element, protruding outwardly from the receiving portion. The coupling element is adapted to be coupled to a corresponding coupling element of a network connector housing. The electrical shielding member further comprises an engagement element, protruding inwardly into the receiving portion, wherein the engagement element is adapted to be engaged with the cable. The electrical shielding member further comprises at least one contact beam, extending from the receiving portion, wherein the contact beam is adapted to be electrically connected to a counter electrical shielding member of a counter connector.

17 Claims, 11 Drawing Sheets

(51) Int. Cl.

| | |
|---|---|
| ***H01R 13/506*** | (2006.01) |
| ***H01R 13/6592*** | (2011.01) |
| ***H01R 43/048*** | (2006.01) |
| ***H01R 43/20*** | (2006.01) |
| ***H01R 13/6591*** | (2011.01) |

(52) U.S. Cl.
CPC ..... *H01R 13/6592* (2013.01); *H01R 43/048* (2013.01); *H01R 43/20* (2013.01); *H01R 13/65912* (2020.08); *H01R 2201/04* (2013.01)

(56) References Cited

U.S. PATENT DOCUMENTS

| | | | | | |
|---|---|---|---|---|---|
| 5,580,268 | A * | 12/1996 | Miyazawa | H01R 13/639 | 439/352 |
| 5,634,809 | A * | 6/1997 | Hirai | H01R 13/6275 | 439/352 |
| 6,080,018 | A * | 6/2000 | Ferrill | H01R 13/6589 | 439/98 |
| 7,628,638 | B2 * | 12/2009 | Wu | H01R 13/6275 | 439/358 |
| 7,727,021 | B2 * | 6/2010 | Haruna | H01R 9/037 | 439/607.5 |
| 8,926,368 | B2 * | 1/2015 | Il | H01R 13/6581 | 439/607.5 |
| 9,373,898 | B1 | 6/2016 | Sovel et al. | | |
| 10,594,086 | B2 * | 3/2020 | Droesbeke | H01R 13/6582 | |
| 10,770,822 | B2 * | 9/2020 | Maesoba | H01R 24/40 | |
| 2006/0063415 | A1 * | 3/2006 | de Vanssay | H01R 13/6275 | 439/350 |
| 2013/0143424 | A1 | 6/2013 | Nguyen et al. | | |
| 2020/0328553 | A1 * | 10/2020 | Pacher | H01R 13/6593 | |

OTHER PUBLICATIONS

International Search Report and Written Opinion dated Aug. 22, 2019.

* cited by examiner

ELECTRICAL SHIELDING MEMBER FOR A NETWORK CONNECTOR

CROSS-REFERENCE TO RELATED APPLICATIONS

This application is a National Stage Application of PCT/EP2019/052643, filed on 4 Feb. 2019, which claims benefit of EP Application No. 18157248.8, filed on 16 Feb. 2018 in the European Patent Office and which applications are incorporated herein by reference. A claim of priority to all, to the extent appropriate, is made.

FIELD OF THE INVENTION

The invention relates to an electrical shielding member for a network connector, an electrical shielding assembly for a network connector and a network connector as well as to a method to assemble the network connector, wherein the network connector is preferably suitable for network communication at data rates of at least 100 Mbits/s and/or 1 Gbit/s. Further the network connector may be used in automotive applications.

BACKGROUND

Network connectors being capable for network communication at data rates of at least 100 Mbits/s and/or 1 Gbit/s may be used in automotive applications, such as vehicles. In recent years, vehicles have been equipped with numerous on-board electronics. These on-board electronics provide a wide field of functionality, such as sensors, control functions and the like. These on-board electronics provide typical consumer electronic functions, navigation control and/or safety features, as well as e.g. feedback control for autonomous driving. For data communication between single on-board electronic components, data networks have been established within vehicles. These data networks communicate at high data rates, to allow for a safe and reliable communication. Typically, data networks are based on Ethernet networks, operating at data rates up to 100 Mbits/s and/or 1 Gbit/s. With providing new kinds of on-board electronics, the need for higher data rates increases. However, the higher the data rate, the higher is the cross-talk level between single branches of the network, particularly if connectors and/or cables of these branches are arranged adjacent and substantially parallel to each other. This is typically the case, if a cable harness is used for wiring the vehicle. Further, with increased data rates, the EMC properties (electro magnetic compatibility) of connectors decreases. Thus, different connectors are provided for 100 Mbit/s networks and 1 Gbit/s networks. To overcome increased cross-talk levels and reduced EMC properties at data rates up to 1 Gbit/s, electrical shielding members are typically provided in a housing of a network connector or the network connector system, to prevent radiation from entering and/or leaving the connector housing. Said electrical shielding members typically entirely surround the connector housing, thereby providing good shielding performance. However, such electrical shielding members cause additional manufacturing costs.

To further improve the shielding performance, known electrical shielding members are typically electrically connected to a separate electrical shielding member of the male connector and/or a further separate electrical shielding member of the female connector. Thus, a continuous shielding can be achieved over the entire connector length. The contact interface between the separate electrical shielding members is typically achieved, using so called contact points. In the art, a contact point is known to have any suitable shape. The shape of a contact point is not reduced to a mathematical point, but can have any suitable shape or area. For example, a contact point can provide a line contact or a surface contact. Contact interfaces and in particular contact points that are provide a reduced conductivity, conferred to a continuous piece of shielding. Thus, there is a need in the art to reduce the number of contact points.

Further, these contact points are typically provided on so-called contact beams, that protrude from a connector and/or a electrical shielding member. Known contact beams are prone to be knicked off or damaged during storage, transport and/or mating. This is undesirable, as vehicle connectors are typically automatically mated. Thus, a damaged connector can lead to undesirable maintenance work at an assembly line and/or may require a manual exchange of the damaged connector.

Further, known electrical shielding members, may be crimped to a cable and inserted subsequently together with the cable in a connector housing. If the cable axial rotates, e.g. to due to wiring a vehicle, there is a risk of displacing the electrical shielding member in relation to the connector housing. If, a rotational displacement occurs, mating forces may increase, a mating may become impossible and/or the connector may be damaged during mating.

Further, a rotational displacement might lead to a partial loosening between the cable, respectively the shielding of the cable and the electrical shielding member arranged thereon. If the electrical connection between the shielding of the cable and the electrical shielding member is loosened, the resistance will increase and the shielding properties will decrease, which is undesirable. Therefore, a reliable connection between the shield of the cable and the electrical shielding member is required.

Further, there is a need in the art for a electrical shielding member that is securely fixed in the housing. Known connectors use a fixation sleeve that is crimped onto an insulation part of the cable and interconnects the cable with the housing. Thus, the cable can be secured rotationally within the housing.

Providing a electrical shielding member and distinct fixation sleeve often requires aligning the electrical shielding member and the fixation sleeve to allow for a correct assembly of the connector. This causes additional costs. Further, some cables can be twisted so that the electrical shielding member can be displaced rotationally with respect to the fixation sleeve, thereby leading to a more complex assembly.

Thus, there is a need in the art to provide an electrical shielding member for a network connector, a network connector and a network connector system that overcome the above-mentioned drawbacks.

SUMMARY OF THE INVENTION

The object is at least partly solved by an electrical shielding member according to claim 1, a shielding assembly according to claim 11, a network connector according to claim 13 and a method to assemble a network connector according to claim 15.

In particular, the object is solved by an electrical shielding member for a network connector, wherein the electrical shielding member is made from bend and cut sheet metal and wherein the electrical shielding member comprises a receiving portion for receiving a cable end of a shielded cable at least partially. The receiving portion is adapted to be electrically connected with a shielding of the cable and comprises at least one coupling element protruding outwardly from the receiving portion, wherein the coupling element is adapted to be coupled to a corresponding coupling element of a network connector housing. Further, the coupling element is a coupling protrusion, embossed in the receiving portion. The receiving portion comprises further an engagement element, protruding inwardly into the receiving portion, wherein the engagement element is adapted to be engaged with the cable and/or a fastening ferrule of the cable. The electrical shielding member further comprises at least one contact beam, extending from the receiving portion, wherein the contact beam is adapted to be electrically connected to a counter electrical shielding member of a counter network connector.

The electrical shielding member enables a network connector to communicate at data rates of at least 100 Mbit/s and preferably of at least 1 GBit/s. Forming the electrical shielding member from bent and cut sheet metal allows to provide high shielding performance, at reduced costs. Further, the electrical shielding member may be made from a single piece of bend and cut sheet metal. Thus, manufacturing and assembling costs of the network connector can be further reduced.

The electrical shielding member allows for a secure fixation within a network connector housing and further for a secure fixation of a cable end within the receiving portion, as the electrical shielding member can easily be crimped on or wrapped around a cable end to provide a reliable mechanical and electrical connection between the shielding of the cable and the electrical shielding member. The cable may comprise a fastening ferrule, which forms an inner ferrule of a shielding assembly, as described later.

The receiving portion may entirely enclose the cable end, if the cable end is received within the receiving portion. Particularly, the receiving portion may enclose the cable end on at least 300°, preferably on at least 330° and most preferably on 360°, to provide a fully shielded cable end.

The receiving portion may at least partially be wrapped around the cable end and can be crimped thereto. Further, the receiving portion can alternatively or additionally comprise a solder portion and/or a welding portion, to solder or weld the receiving portion with the shielding of the cable. The shielding of the cable can be provided in form of a stranded shielding, a braided shielding, a foil shielding or any other type of shielding. A first part of the receiving portion may be in direct contact with a shielding of the cable, wherein another second part of the receiving portion may be in direct contact with the insulation of the cable. In particular, the inwardly protruding engagement element may engage with an insulation of the cable to increase the engagement between the cable and the electrical shielding member.

The coupling elements protrude outwardly. In the case of a substantially cylindrical receiving portion, the coupling elements may protrude radially outward, to couple with a corresponding coupling element of a network connector housing by form fit or force fit. Particularly, the coupling element and the engagement element may lead to a retention force of the cable form a connector housing of at least 80 N, preferably of at least 100 N and most preferably of at least 130N, when axially pulling on the cable.

The at least one contact beam that extends from the receiving portion allows to electrically connect the electrical shielding member with a counter electrical shielding member of a counter network connector. Thus, the number of separate electrical shielding members can be reduced from three to two, as no separate electrical shielding member is required in a connector housing. Thus, the number of serial contact interfaces can be reduced, resulting in a reduction of the resistance of the overall shielding. Thus, the shielding performance can be improved and allows for improved cross talk and EMC properties.

The receiving portion may have a substantially cylindrical form, when the cable end is received within the receiving portion. Further, the receiving portion may be adapted to be crimped on the cable end. A substantially cylindrical form allows for a safe electrical and mechanical connection between the electrical shielding member and the cable end. The cylindrical shape of the receiving portion further allows for a fully (i.e. preferably 360°) shielding of the cable.

The receiving portion can be pre-formed in the substantially cylindrical form and may be crimped subsequently on the cable end and/or the receiving portion. Further, the receiving portion may be wrapped around the cable end during the assembly, i.e. the cylindrical form is not pre-formed, but achieved due to wrapping the metal sheet that forms the receiving portion around the cable end. Thus, the receiving portion fits perfectly to the cable end, independently of the tolerances of the cable diameter.

Further, a first part of the receiving portion may be in direct contact with a shielding of the cable, wherein another second part of the receiving portion may be in direct contact with the insulation of the cable. This allows for a reliable mechanical and electrical contact between the receiving portion and the cable end.

The electrical shielding member may comprise multiple engagement elements. The engagement elements may be arranged so that at least a first engagement element or multiple engagement elements is/are engaged with the cable, in particular with a cable jacket. Further, at least a second engagement element or multiple engagement elements may be engaged with a fastening ferrule of the cable. Providing multiple engagement elements allows for increased retention forces of the cable. In particular, a retention force of the cable from the electrical shielding member of more than 80 N, preferably of more than 100N and most preferably of more than 130 N can be achieved.

At least one engagement element can be an embossed element and may comprise a perforated section. The perforated section may further comprise a cut edge, that intersects the longitudinal direction of the cable under an angle of about 90°, in the assembled state. Still further, the perforated section may comprise a cut face that faces into the direction of the cable end, when the cable end is received within the receiving portion.

An embossed engagement element is easy to manufacture and is very cost effective. If the engagement element comprises a perforated section, the engagement between the cable and the receiving portion can be increased. For example, a retention force of at least 80 N, preferably of at least 100 N and most preferably of at least 130 N can be achieved.

The perforated section having a cut edge further increases the retention force, as the cut edge can carve into a shielding and/or an insulation and/or any other part of the cable. Further, providing a cut face that faces into the direction of the cable end, allows to further increase the retention force, as the engagement element may act as a barb. Thus, a reliable engagement between the cable and the electrical shielding member can be achieved.

At least one engagement element may be an embossed element, such as an embossed rib, that comprises a first shoulder and a second shoulder, wherein the first and second shoulders form an edge that protrudes inwardly into the receiving portion. Preferably, the edge intersects the longitudinal direction of the cable to be received under an angle of about 90°. An embossed engagement element is easy to manufacture and is very cost effective. The edge allows to increase the engagement between the cable and the receiving portion. For example, a retention force of at least 80 N, preferably of at least 100 N and most preferably of at least 130 N can be achieved. Further, the second shoulder of the engagement element can engage with a corresponding engagement element of an inner ferrule (fastening ferrule) of the cable, as described in greater detail below, to further increase the retention force. Still further, tolerances in retention force can be reduced, so that an equally high quality of the electrical shielding member can be guaranteed.

The first shoulder of the at least one engagement element may enclose an acute angle with an inner surface of the receiving portion. Further, the first shoulder and the second shoulder may enclose an angle in the range of 75 to 105°, preferably in the range of 85° to 95° and most preferably of about 90°, wherein the second shoulder faces into the direction of the cable end, when the cable end is received within the receiving portion. This configuration allows to provide high retention forces with low tolerances.

At least two of the engagement elements may have a different width in a direction perpendicular to the longitudinal direction of the cable. This allows to provide multiple engagement elements at different axial sections of the receiving portion, independently of the presence of further elements, such as primary fastening elements, lateral trough-openings, coupling elements, secondary fastening elements, primary locking protrusions, primary locking recesses, secondary locking protrusions, secondary locking recesses, or the like.

Still further, at least two of the engagement elements may have a different protruding height. With varying the width and/or the height of the engagement elements, different engagement elements can be provided that engage the cable and/or the fastening ferule differently. This allows to further adjust a desired retention force.

The coupling element is a coupling protrusion that is embossed in the receiving portion. The coupling element can comprise a cut face, that may face away from the cable end, when the cable end is received within the receiving portion. Providing the coupling element as an embossed element allows for a cost-effective manufacturing. Further, the coupling element can comprise a cut face that may face away from the cable end. Therefore, the cut face can serve as an abutment surface for a corresponding coupling element of a connector housing. If the coupling element is coupled to the corresponding coupling element of the connector housing, there can be a force fit or a form fit. Therefore, the retention force of the electrical shielding member from the connector housing can be increased and can be at least 80 N, preferably at least 100 N and most preferably at least 130 N.

Further, at least three sides of the coupling element may be connected with the receiving portion. This allows to provide a very stable and stiff coupling element and therefore high retention forces between a connector housing and the electrical shielding member. This is, as the coupling element is less prone from being deflected or damaged, if securely connected to the receiving portion. The electrical shielding member may further comprise at least two coupling elements preferably at least three coupling elements and even more preferably at least four coupling elements. Particularly, the coupling elements may be equally distributed around a circumference of the receiving portion of the electrical shielding member.

Providing at least two coupling elements the retention force between the electrical shielding member and the connector housing can be further increased. Distributing the coupling elements substantially equally around a circumference of the receiving portion allows to maintain a retention force that is independent of a retention angle. Thus, a more reliable network connector can be provided. The receiving portion may have an axial length in the range of 3 to 8 mm, preferably in the range of 4 to 6.5 mm and most preferably in the range of 5 to 6 mm. These lengths allow to provide a small connector with a reliable secured cable. Said length of the receiving portion allows to provide a sufficient mechanical connection between the electrical shielding member and the cable and to achieve high retention forces. Further, said length prevents the received cable from kinking, as the cable is held and supported over the length of the receiving portion.

Further, the receiving portion may have an outer diameter that is adapted to the cable to be received and may be for example in the assembled state in the range of 3 to 6 mm, preferably in the range of 3.5 to 5.5 mm and most preferably in the range of 3.8 to 4.2 mm.

The receiving portion may comprise opposing joint rims, wherein a first joint rim is provided a primary locking protrusion and the second joint rim is provided with a corresponding primary locking recess. Further, the first joint rim may be provided with at least one secondary locking recess and the second joint rim may be provided with at least one corresponding secondary locking protrusion. As the electrical shielding member is formed from bent and cut sheet metal, the receiving portion that receives the cable at least partially has longitudinally oriented joint rims. The joint rims may also carve into the cable and provide for higher retention forces. Further, the joint rims can be provided with a locking contour. A locking contour of the first joint rim may be provided with a locking protrusion and the opposing locking contour of the second joint rim may be provided with a corresponding primary locking recess. When the electrical shielding member is arranged on the cable end, e.g. wrapped around the cable end, to be crimped, soldered or welded or fastened in any other suitable manner, the primary locking protrusion engages with the primary locking recess to form a stable receiving portion. Thus, the receiving portion cannot be easily removed from the cable and provides a reliable and secure fastening, as well as a reliable and secure electrical contact.

Additionally, the locking contour may comprise secondary locking protrusions and/or recesses that may be provided on the opposing joint rims to further increase the locking between the joint rims.

The electrical shielding member may further comprise at least one primary fastening element, wherein the primary fastening element protrudes inwardly into the receiving portion and is preferably provided at an end of the receiving portion that faces away from the end of the cable. The primary fastening element allows for an additional fastening between the cable and the electrical shielding member. For example, two primary fastening elements can be provided on the end of the receiving portion, thereby clamping the cable in the receiving portion, when the receiving portion is fastened on the cable end, preferably by crimping. Therefore, a more reliable connection can be provided.

Further, the electrical shielding member may comprise a lateral trough opening adjacent to the primary fastening element. This lateral trough opening may receive a portion of the cable insulation material, if the electrical shielding member is fastened to a cable end. Particularly, the lateral trough opening may receive a portion of the cable insulation material that is displaced by the primary fastening element. Thus, the retention force can be further increased.

The electrical shielding member may further comprise a secondary fastening element, wherein the secondary fastening element protrudes inwardly into the receiving portion and is preferably provided at a distal end of the receiving portion that faces into the direction of the cable end.

The secondary fastening element may further improve the mechanical connection between the cable and the electrical shielding member and increase the retention force. By providing a secondary fastening element at a distal end of the receiving portion that faces into the direction of the cable end, the cable can be fastened very reliably within the electrical shielding member. The secondary fastening element is preferably embossed into the electrical shielding member. The secondary fastening element may have a wave like form, having at least one trough, that encircles the receiving portion at least partially. The at least one trough allows for a local hard crimping. Thus, the electrical contact between the receiving portion and a shielding of the cable end can be increased. Further, the cable can be fastened around the circumference of the cable which leads to an improved fastening.

The at least one contact beam of the electrical shielding member and the receiving portion may be integrally formed. By integrally forming the contact beam and the receiving portion of the electrical shielding member, the electrical shielding member can be manufactured very cost-effectively and the shielding properties of the electrical shielding member can be increased, as no contact interface between the contact beam and the receiving portion, for example in form of contact points, is required. If the electrical shielding member is installed with a network connector and this network connector is coupled to a counter connector, the electrical shielding member can directly contact the counter electrical shielding member of the counter connector by its contact beams. Thus, a very high cross-talk dampening and high EMC properties can be achieved. The object is further solved by an electrical shielding assembly for a network connector. The electrical shielding assembly comprises an inner ferrule, that is adapted to be crimped on a stripped cable end of a shielded cable to be in electrical contact with a shielding of the cable and an outer ferrule, wherein the outer ferule is an electrical shielding member, as described above. The electrical shielding member is adapted to be crimped over the inner ferrule, so that the inner ferrule is at least partially received within the receiving portion of the electrical shielding member.

The electrical shielding assembly allows for a secure electrical connection between the shield of the cable and the electrical shielding member and for a strong mechanical connection. In particular, the inner ferrule can be made from a cut and bent sheet metal, wherein the sheet metal has a sheet thickness that corresponds to a thickness of an insulation of the cable. Thereby, if the electrical shielding member is crimped partly onto the shielding of the cable and partly onto the insulation of the cable, a height difference of the insulation can be compensated and the electrical shielding member can be arranged essentially concentrically to the cable, so that a fastening between the cable and the electrical shielding member can be increased. Further, with providing an inner ferrule, the shielding of the cable can be secured in a defined way, and for example strands of braided shields are less prone to be broken off during fastening of the electrical shielding member.

Still further, if the inner ferrule is crimped on the shielding of the cable, the shielding of the cable can be folded back and subsequently, the electrical shielding member can be crimped over the folded back shielding of the cable and inner ferrule, thereby sandwiching the shielding of the cable between the inner ferrule and the electrical shielding member. This allows for a strong mechanical fixation and a reliable electric contact between the electrical shielding member and the shielding of the cable, thereby increasing the crosstalk level and the EMC performance.

Particularly, the inner ferrule may have a substantially sleeve shape. Thus, the inner ferrule can be installed angularly independent. This reduces the manufacturing costs. With providing a sleeve-shaped inner ferrule, all structural features, such as contact beams, fastening elements, locking elements and/or engagement elements may be provided on an outer ferrule, which may be the above described electrical shielding member. Thus, also the electrical shielding member can be crimped over the inner ferrule angularly independent. Further, the risk of displacement of structural features during crimping is reduced, as all structural features may be provided on the electrical shielding member and deform during crimping equally. Structural features in this respect are in particular theses features, that engage or communicate with other parts of the connectors, such as a connector housing or the like.

Further, the inner ferrule may comprise a number of engagement protrusions that protrude inwardly and/or outwardly into the inner ferrule, wherein the engagement protrusions can be formed as embossment, piercing, rim hole, and/or a louver or a combination thereof. With providing engagement protrusions, the inner ferrule can be arranged on the shielding of the cable in a reliable manner. Inwardly oriented engagement protrusions may carve into the shielding of the cable. Thus a strong connection between the cable and the inner ferrule can be provided. Outwardly oriented engagement protrusions may carve into the electrical shielding member and/or a portion of the shielding of the cable that is folded back over the inner ferrule. Therefore, the retention force of the cable can be further increased and the electrical contact can be improved. The inner ferrule may further comprise at least one corresponding engagement element that protrudes outwardly from the inner ferrule, wherein the corresponding engagement element is adapted to be engaged with an engagement element of the electrical shielding member, when the electrical shielding member is crimped over the inner ferrule. The engagement of corresponding engagement element(s) and engagement element(s) of the electrical shielding member allows to provide a defined retention force between the cable (respectively the inner ferrule) and the electrical shielding member with reduced tolerances. The retention force of the cable from the electrical shielding member can be at least 80 N, preferably at least 100 N and most preferably at least 130 N.

The corresponding engagement element of the inner ferrule may be formed as embossed element, and may comprise a perforated section, wherein the perforated section may further comprise a cut edge, that intersects the longitudinal direction of the cable to be received under an angle of about 90°. The perforated section may further comprise a cut face that faces into the opposite direction of the cable end, when the inner ferrule is arranged on the stripped cable end. The cut edge and/or the cut face is suited to provide a secure engagement between the corresponding engagement element of the inner ferrule and the engagement element of the electrical shielding member, thus increasing the retention force.

Further, the corresponding engagement element of the inner ferrule may be an engagement arm, having a free end that faces into the opposite direction of the cable end, when the inner ferrule is arranged on the stripped cable end. Providing a free arm allows the corresponding engagement element to at least partly adapt to the position and shape of the engagement element of the electrical shielding member. Therefore, a secure engagement can be guaranteed, even if the s electrical shielding member and the inner ferrule are not perfectly aligned to each other.

The inner ferrule may further comprise an abutment face that is arranged on a front face of the inner ferrule. The abutment face faces into the opposite direction of the cable end, when the inner ferrule is arranged on the stripped cable end. Said abutment face is adapted to be engaged with an engagement element of the electrical shielding member, when the electrical shielding member is crimped over the inner ferrule. The abutment face allows to further increase the retention force.

Further, the inner ferrule may comprise a locking contour, similarly to the receiving portion of the electrical shielding member. A locking contour of the inner ferrule may be provided with a locking protrusion on a first joint rim and with an opposing locking recess on a second joint rim. When the inner ferrule is arranged on the cable end, e.g. wrapped around the cable end to be crimped, the locking protrusion engages with the locking recess to form a stable receiving portion. Thus, the inner ferrule cannot be easily removed from the cable and provides a reliable and secure fastening, as well as a reliable and secure electrical contact. Further, the joint rims of the inner ferrule may protrude at least partially inwardly and/or outwardly to engage with the shielding of the cable and/or the electrical shielding member, to further improve the mechanical and/or electrical connection.

The object is further solved by a network connector assembly, wherein the network connector assembly may be capable of communicating at data rates of at least 100 Mbit/s and/or at least 1 Gbit/s. The network connector assembly comprises a shielded cable, at least one electrical contact terminal, being electrically connected to a wire of the cable and a network connector housing. The network connector assembly further comprises an electrical shielding member as described above, wherein the inner ferrule, is crimped on a stripped cable end of the shielded cable and is in electrical contact with a shielding of the cable, and wherein the shielding of the cable is folded back, and covers the inner ferrule at least partially. The electrical shielding member is crimped over the shielding that convers the inner ferrule, so that the shielding of the cable is at least partially sandwiched between the inner ferrule and the electrical shielding member. The network connector housing may comprise at least one counter coupling element, wherein the counter coupling element may couple with the coupling element of the electrical shielding member.

With providing a counter coupling element, the coupling element of the electrical shielding member can be coupled with the connector housing. Thereby, the retention force can be significantly increased. Further, the coupling between the coupling element and the counter coupling element prevents the electrical shielding member and/or the cable from a rotational displacement. Therefore, the electrical connector assembly is more reliable. As rotational displacement can be prevented, the risk of damaging the connector during mating or assembling is significantly reduced.

The electrical contact terminal may have a primary locking means and the connector housing may have a corresponding primary locking means, that engage with each other when the terminal is assembled. Further, the electrical contact terminal may have a secondary locking means and the connector housing may have a corresponding secondary locking means, that engage with each other when the terminal is assembled. The primary locking means, the corresponding primary locking means, the secondary locking means, the corresponding secondary locking means and the coupling element and the counter coupling element may be arranged so that, when pulling the cable out of the connector housing, firstly the primary locking means and the corresponding primary locking means abut each other. Subsequently, the coupling element and the counter coupling element may abut each other and thereafter, the secondary locking means and the corresponding secondary locking means may abut each other. Thus, the cable can be held reliable with in the connector housing, without losing its electrical connection.

Assembling the network connector assembly, may comprise the following steps:

providing a shielded cable, having a stripped cable end;

providing an inner ferrule, wherein the inner ferrule may be provided in a substantially flat condition and crimping the inner ferrule on the stripped cable end so that the inner ferrule is in electrical contact with a shielding of the cable;

folding the shielding of the cable back, so that the shielding covers the inner ferrule at least partially;

providing an electrical shielding member, wherein the electrical shielding member is preferably provided in a substantially flat condition, and crimping the electrical shielding member over the shielding that convers the inner ferrule, so that the shielding is at least partially sandwiched between the inner ferrule and the electrical shielding member, wherein the method preferably further comprises the following step:

providing a network connector housing and arranging the electrical shielding member at least partially within the network connector housing, so that a coupling element of the electrical shielding member couples with a counter coupling element of the network connector housing.

The above-described method allows to provide a network connector assembly with the advantages as described above in a cost-effective manner. Particularly providing the inner ferrule and/or the electrical shielding member in a substantially flat condition and wrapping the inner ferrule and/or the electrical shielding member around the stripped cable end allows to provide greater manufacturing tolerances while achieving a properly fitted connection between the cable end and the inner ferrule and/or the electrical shielding member, respectively.

Further, the assembling may comprise the step of providing a network connector housing and arranging the electrical shielding member at least partially within the network connector housing so that a coupling element of the electrical shielding member couples with a counter coupling element of the network connector housing. Therefore, the electrical shielding member and/or the cable can be reliably secured within the connector housing. Thereby, high retention forces can be achieved and the electrical shielding member can be secured against rotational displacement.

DETAILED DESCRIPTION OF THE FIGURES

In the following, the preferred embodiments of the invention are described in relation to the accompanied figures, wherein FIG. 1 shows a perspective schematic view of an electrical shielding element;

FIG. 4A to FIG. 4L show multiple steps of a method for manufacturing a network connector;

Figure 1:
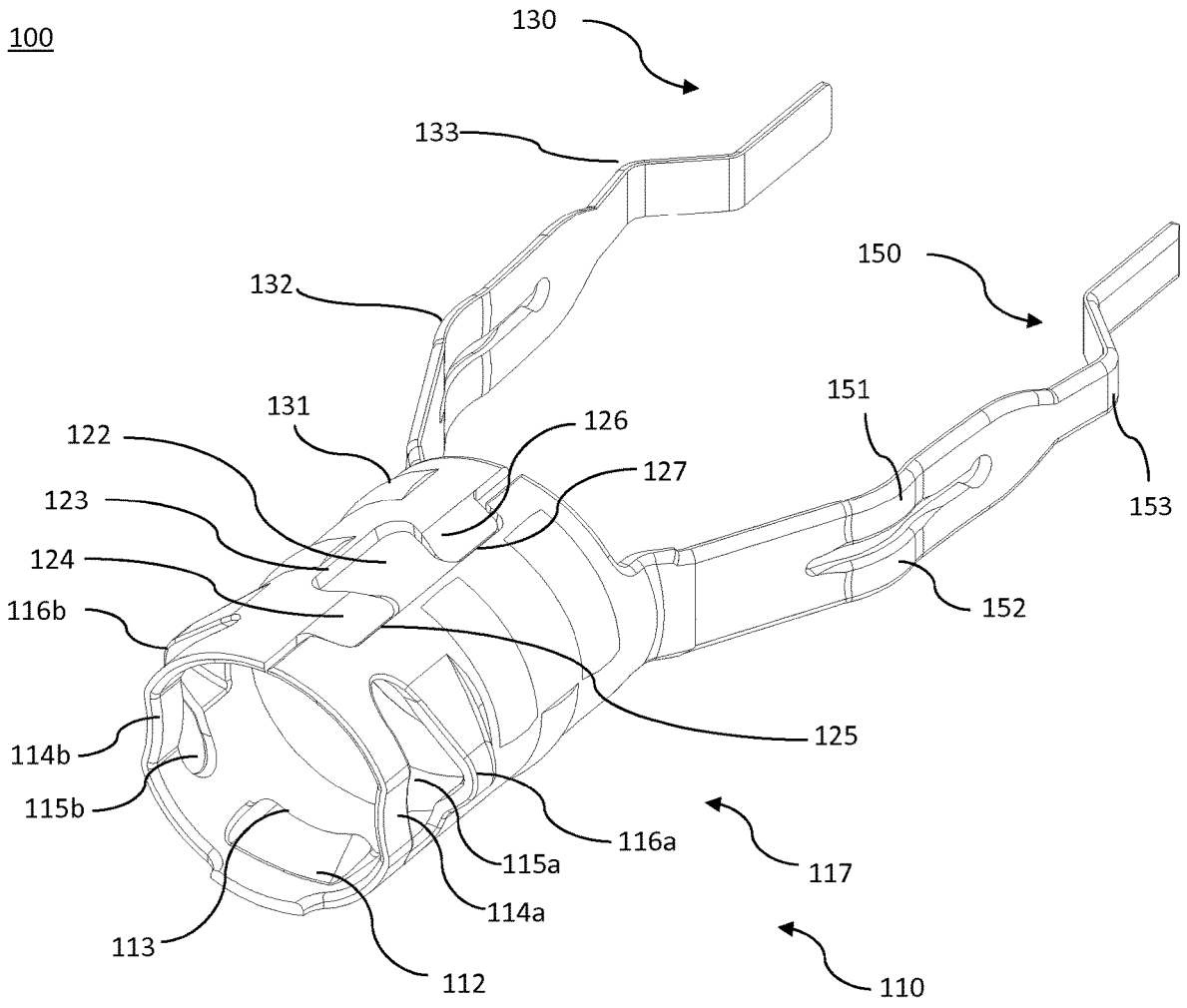

In particular, FIG. 1 shows an electrical shielding member 100, comprising a receiving portion 110 for receiving a cable end of the shielded cable (not shown). The receiving portion 110 has a substantially cylindrical form and is adapted to enclose a cable end entirely. The receiving portion 110 may be wrapped around the cable end during assembly or may be pre-formed in the cylindrical shape.

Further, the electrical shielding member comprises two contact beams 130, 150, wherein each of the contact beams is provided with three distinct contact points 131, 132, 133, respectively 151, 152, 153. The contact points may be provided as line contacts or surface contacts and are adapted for establishing an electrical connection between the electrical shielding member and an electrical shielding member of a corresponding counter connector.

The receiving portion 110 is provided with two coupling elements 116*a*, 116*b*, which protrude outwardly from the receiving portion 110. The coupling elements 116*a*, 116*b* are adapted to be coupled with corresponding coupling elements of a network connector housing (cf. FIG. 4L). The coupling elements 116*a*, 116*b* are provided as coupling protrusions that are embossed in the receiving portion 110. Further, the coupling elements 116*a*, 116*b* comprise a cut-face that faces away from the cable end when the cable is received within the receiving portion 110. Further, the electrical shielding member 100 comprises an engagement element 112, which is adapted to be engaged with a cable, in particular with a cable insulation, when the electrical shielding member 100 receives said cable. The engagement element 112 protrudes inwardly into the receiving portion 11*o* and is provided with a perforated section 113. The perforated section comprises a cut-edge that intersects the longitudinal direction of a cable to be received under an angle of about 90°. Further, the perforated section comprises a cut-face that faces into the direction of the cable end, when the cable would be received within the receiving portion. The cut-face may act as a barb. Therefore, the engagement element 112 and in particular the perforated section 113 can carve into the cable and/or the cable insulation, to allow for a reliable fastening of the electrical shielding member 100.

The electrical shielding member 100 of FIG. 1 is formed from bent and cut sheet metal, so that a preform of the electrical shielding member is a substantially flat piece of metal sheet. By cutting and embossing, the single structural features can be provided and the final shape is achieved by bending or wrapping the electrical shielding member 100.

Still further, the electrical shielding member 100 comprises opposing joint rims. A first joint rim is provided with a primary locking protrusion 122, and the second opposing joint rim is provided with a corresponding primary locking recess 123. The locking protrusion and locking recess 122, 123 engage with each other, when the electrical shielding member 100 is bent or wrapped in the form as shown in FIG. 1. Thus, a very stable electrical shielding member 100 can be provided. The engagement of the locking elements 122, 123 can be achieved prior to arranging the electrical shielding member on the cable end or during arranging the electrical shielding member on the cable end. In particular, the engagement can occur during crimping and/or during wrapping. Further, the first joint rim can be provided with secondary locking recesses 125, 126 and the opposing second joint rim can be provided with corresponding secondary locking protrusions 124, 126 for further engagement.

The electrical shielding member 100 is provided with primary fastening elements 114*a*, 114*b*, which are provided at an end of the receiving portion 11*o* that faces away from the end of the cable, in an assembled state. The primary fastening elements 114*a* and 114*b* protrude inwardly into the receiving portion 110 and clamp the cable within the receiving portion 110 when the receiving portion is installed. Further, the electrical shielding member 100 is provided with lateral through openings 115*a*, 115*b* that are provided adjacent to the primary fastening elements 114*a* and 114*b*. Thus, insulation material of the cable that is displaced by the primary fastening elements 114*a* and 114*b* can be received within the lateral through openings 115*a*, 115*b*. This would increase the retention force.

The electrical shielding member 100 may be provided with a secondary fastening element 117, wherein the secondary fastening element 117 protrudes inwardly and is provided at a distal end of the receiving portion, i.e. the end of the receiving portion that is oriented towards the cable end. The secondary fastening element 117 can be an embossed element that can be provided in a substantially wave form. Particularly, the secondary fastening element 117 can extend from a first joint rim to a second joint rim and encircle the receiving portion 110 almost entirely. Therefore, the fastening between the cable and the electrical shielding member 100 can be further increased.

As shown in FIG. 1, the entire electrical shielding member may be integrally formed, i.e. formed from one piece of metal sheet. Therefore, a very cost effective electrical shielding member can be provided.

Figure 2A:
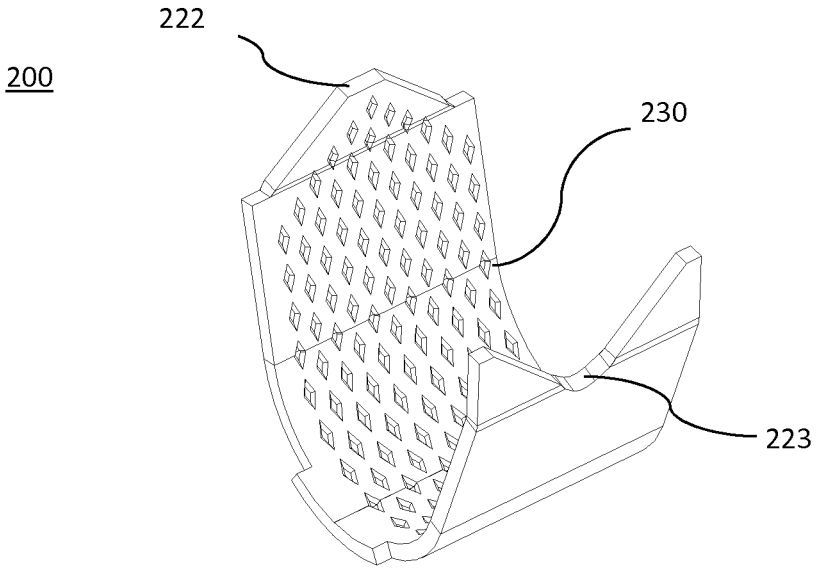
FIG. 2A shows a perspective schematic view of an inner ferrule in an uncrimped state.
Figure 2B:
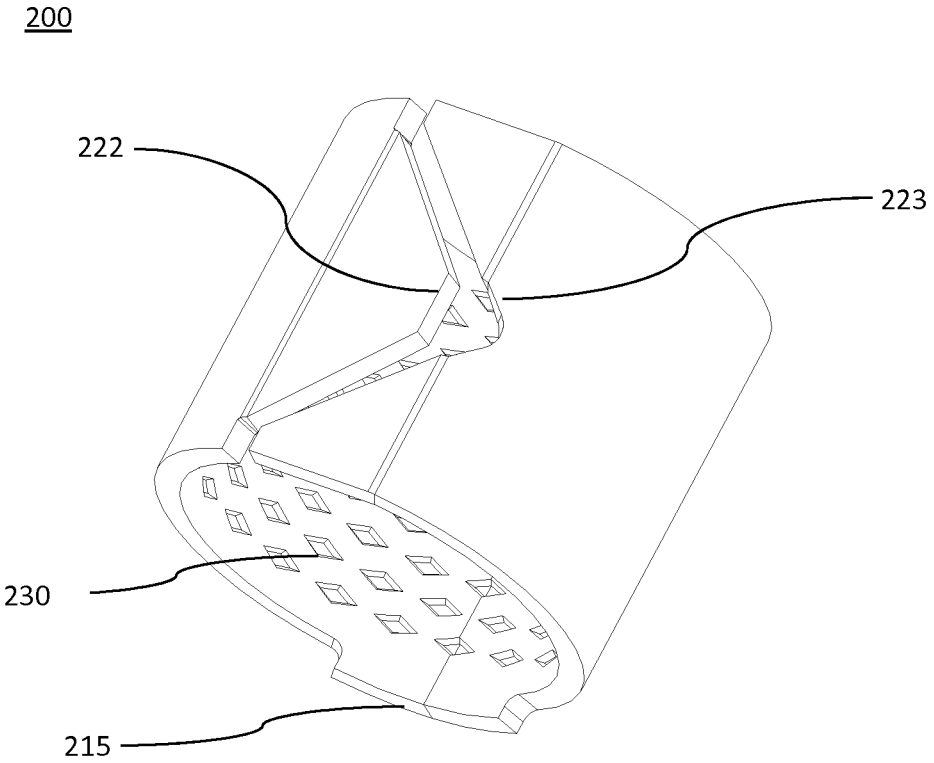
FIG. 2B shows a schematic view of the inner ferrule in a bend shape.

FIG. 2A shows an inner ferrule 200, which can be used together with the electrical shielding member 100 as described with reference to FIG. 1, to from an electrical shielding assembly. The inner ferrule 200 comprises a sleeve that is formed from cut and bent sheet metal. On joint rims, the inner ferrule is provided with a locking protrusion 222 and on the opposing rim with a locking recess 223, which engage with each other, if the inner ferrule 200 is formed into sleeve form as shown in FIG. 2B. The inner ferrule can be formed in sleeve form either during crimping or previously. Particularly, the inner ferrule 200 can be supplied in a substantially flat form in an assembly line of a connector. The inner ferrule may be provided with engagement protrusions 230 that protrude inwardly and/or outwardly. These engagement protrusions 230 lead to an increased retention force. Further, the inner ferrule 200 can comprise an abutment face 215 that is arranged on a front face of the inner ferrule 200. The abutment face faces into the opposite direction of the cable end, when the inner ferrule is arranged on the stripped cable end (cf. FIG. 4D.) Said abutment face 215 is adapted to be engaged with an engagement element 112*b* of the electrical shielding member as e.g. shown in FIG. 8.

Figure 3A:
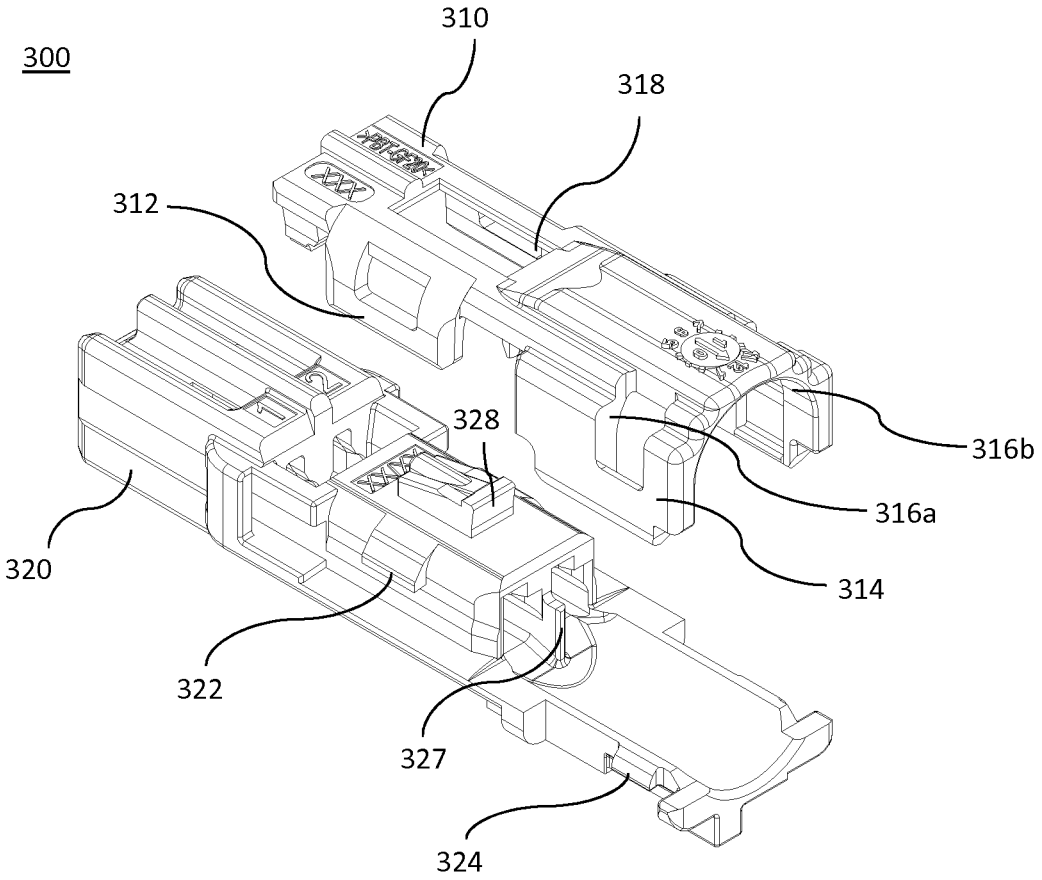
FIG. 3A shows a perspective schematic view of an exploded view of the network connector housing.

FIG. 3A shows a housing 300 of a network connector 10. The housing 300 may comprise a first housing part 310 and a second housing part 320. The first housing part 310 can be provided with at least one primary latching arm 312, wherein the second housing part comprises a corresponding primary latching element 322. During assembling the housing, the latching arm 312 and latching element 322 will latch with each other to fasten the parts 310, 320 of the housing 300. The primary latching element 322 can be provided as a latching nose. Further, the first housing part 310 can be provided with a secondary latching arm 314 which is adapted to latch with a secondary latching element 324 of the second housing part 320. Still further, the first housing part 310 can be provided with a coupling opening 318 that is adapted to couple with a corresponding coupling protrusion 328 of the first housing part. The corresponding coupling protrusion 328 may protrude through opening 318 and may further serve to couple with a collector housing (cf. FIG. 6B).

Further, the housing 300 and in particular the second housing part 320 can be provided with a stopping member 327. The stopping member 327 may be arranged in a middle portion of the housing part 320 and may be sandwiched between a first and second electrical contact terminal receiving channel. Each of the first and second electrical contact terminal receiving channel is adapted to receive the first and second electrical contact terminals 530, 540, respectively, in an assembled state of the connector 10. The stopping member 327 is adapted to abut with an intersecting point of the cable 400, wherein the intersecting point of the cable, is the point, where the first and second wires 430, 440 leave the cable insulation sleeve 415. Thus, the stopping member 327 allows to limit the insertion depth of the cable 400 and/or the electrical shielding member 100 into the housing 300.

Still further, the housing is provided with counter coupling elements 316*a*, 316*b*. In particular, the first housing part 310 may be provided the counter coupling elements 316*a*, 316*b*. The counter coupling elements 316*a*, 316*b* are adapted to couple with the coupling elements 116*a*, 116*b* of the electrical shielding member 100 to secure the electrical shielding member 100 and respectively the cable within the housing 300.

Figure 3B:
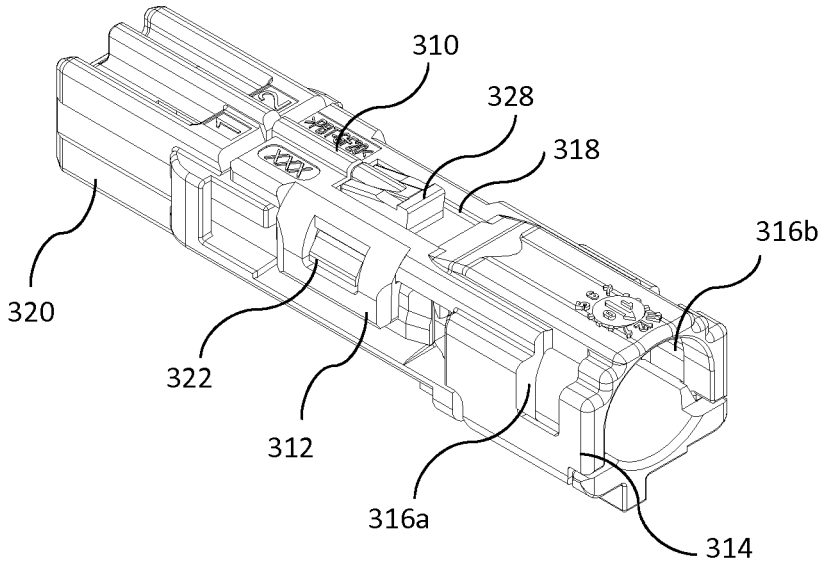
FIG. 3B shows a perspective schematic view of the network connector housing in an assembled state.

FIG. 3B shows the housing 300 in an assembled state. The cable and the electrical shielding member are not shown. In particular, the latching arms 312, 314 engage with the respective latching elements 322, 324.

Figure 4A:
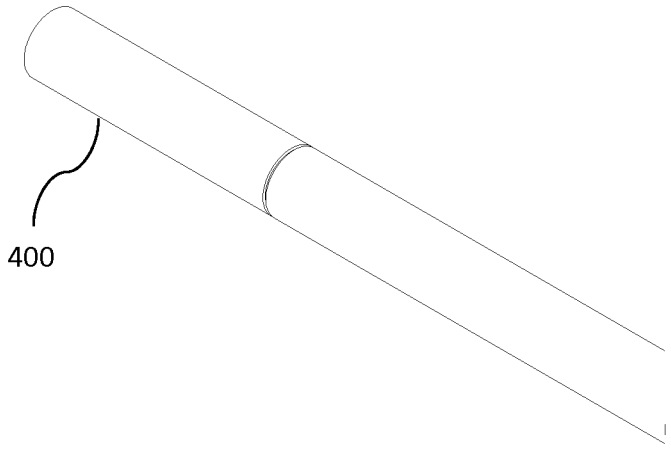
Figure 4B:
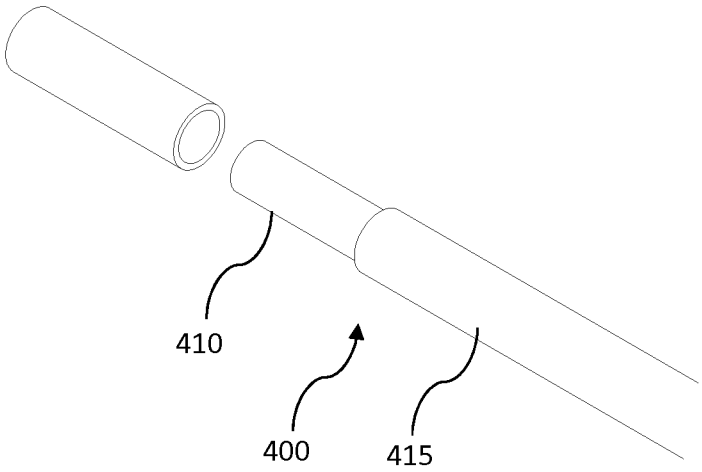

FIGS. 4A to 4L illustrate some manufacturing steps of a method to manufacture a network connector assembly 10. The order of the shown manufacturing steps is only illustrative and can be different. In a first method step as shown in FIG. 4A, a cable 400 is provided. The cable comprises an insulation 415 and a shielding 410. In a second method step as shown in FIG. 4B, the insulation 415 is partly removed and the shielding 410 is laid open, to provide a stripped cable end.

Figure 4C:
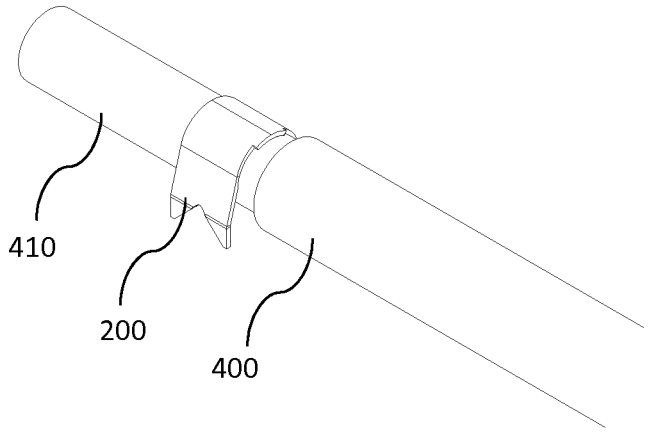
Figure 4D:
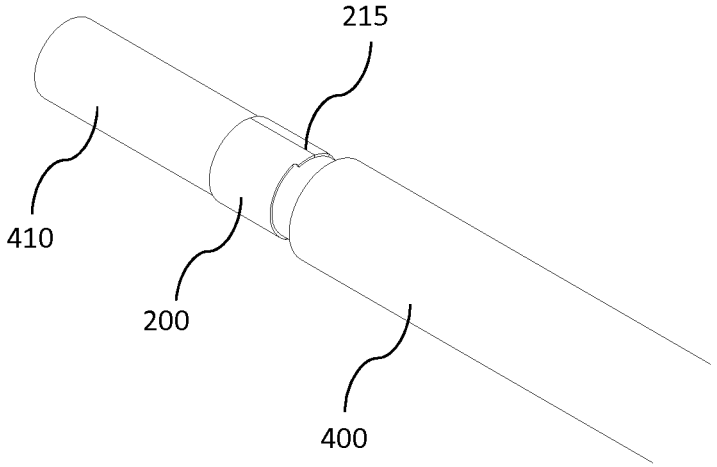
Figure 4E:
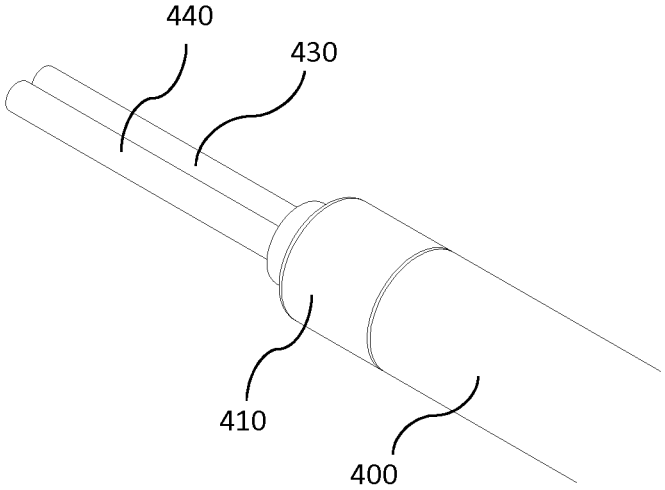
Figure 4G:
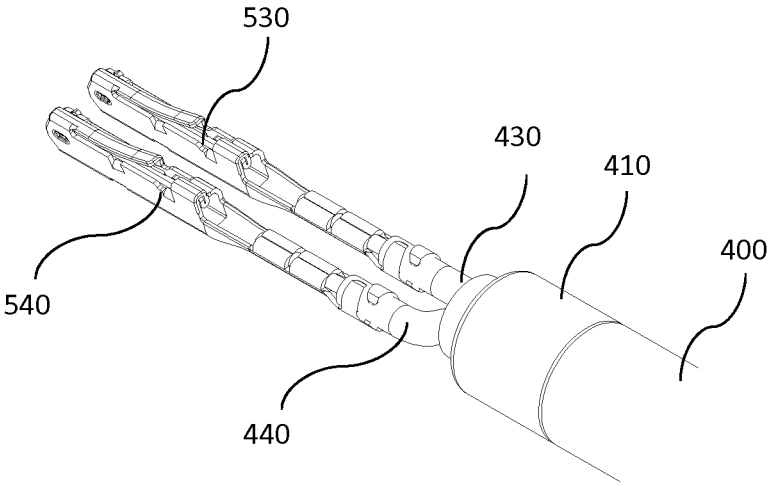
Figure 4H:
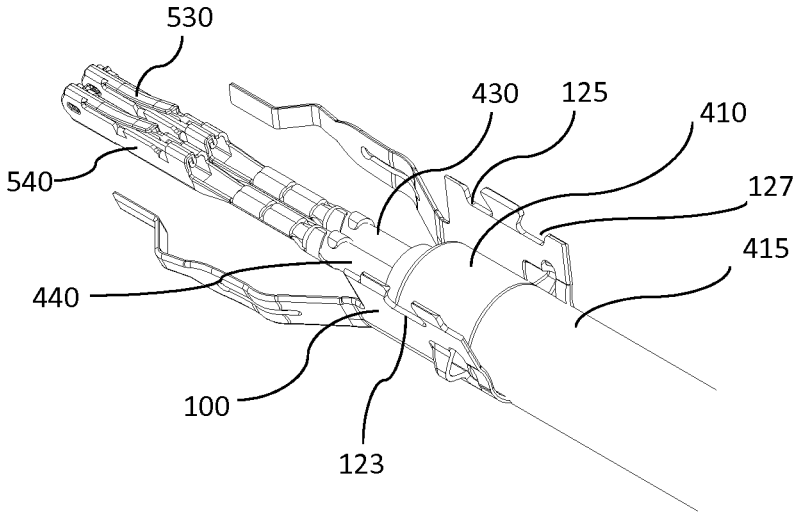
Figure 4I:
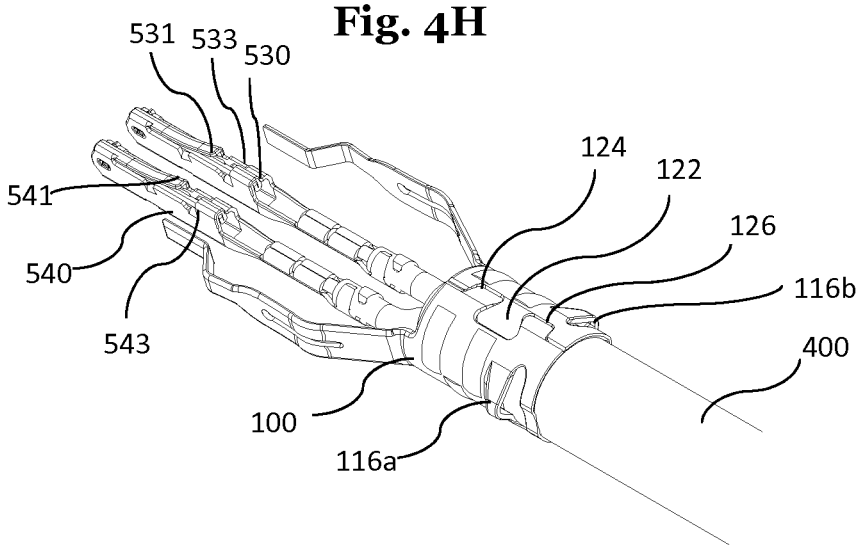

In FIG. 4C, in a third method step, the inner ferrule 200, as described with respect to FIGS. 2A and 2B, is provided and wrapped around the shield 410 of the cable 400. The inner ferrule 200 may be provided in a substantially flat shape and may be wrapped around the cable end before crimping. The crimped inner ferrule 200 is shown in FIG. 4D. After wrapping and/or crimping, the inner ferrule 200 forms a substantially cylindrical sleeve around the shielding 410 of the cable 400, wherein an abutment face 215 faces into the opposite direction of the cable end. The abutment face 215 may protrude from the inner ferrule 200 in the opposite direction of the cable end. In a further method step as shown in FIG. 4E, the shield 410 of the cable 400 is folded back to cover the inner ferrule 200, at least partially. As shown in FIG. 4G, the wires 430 and 440 of the cable 400 can be provided with contact terminals 530, 540. The cable 400 may be a twisted cable, with shielded or unshielded wires 430, 440.

After having provided the contact terminals 530, 540 to the wires 430, 440, the electrical shielding member 100 is assembled. The electrical shielding member 100 may be provided in a substantially flat shape and may be wrapped around the cable end, respectively the inner ferrule 200, before crimping. Thus, the electrical shielding member 100 may cover the folded back shielding 410, the inner ferrule 200 and the insulation 415 of the cable 400 at least partially. The engagement element 112 (not shown) can carve into the insulation 415 of the cable 400. Subsequently, the electrical shielding member 100 is crimped, so that the locking contour, comprising primary and secondary locking recesses and protrusions 122 to 127 engage with each other, as shown in FIG. 41. As shown in FIG. 41, the electrical contact terminal 530, 540 may have a primary locking means 531, 541 in form of a latching arm and a secondary locking means 533, 543 in form of a locking recess. The primary locking means 531, 541 and/or secondary locking means 533, 543 serve to lock the electrical contact terminal 530, 540 within the connector housing, as described in greater detail with respect to FIG. 6.

Figure 4J:
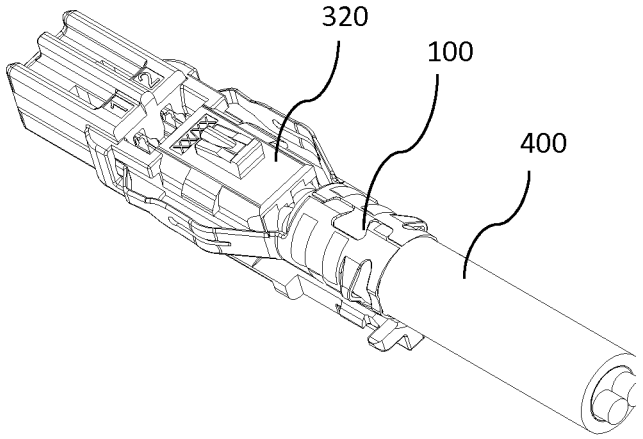
Figure 4K:
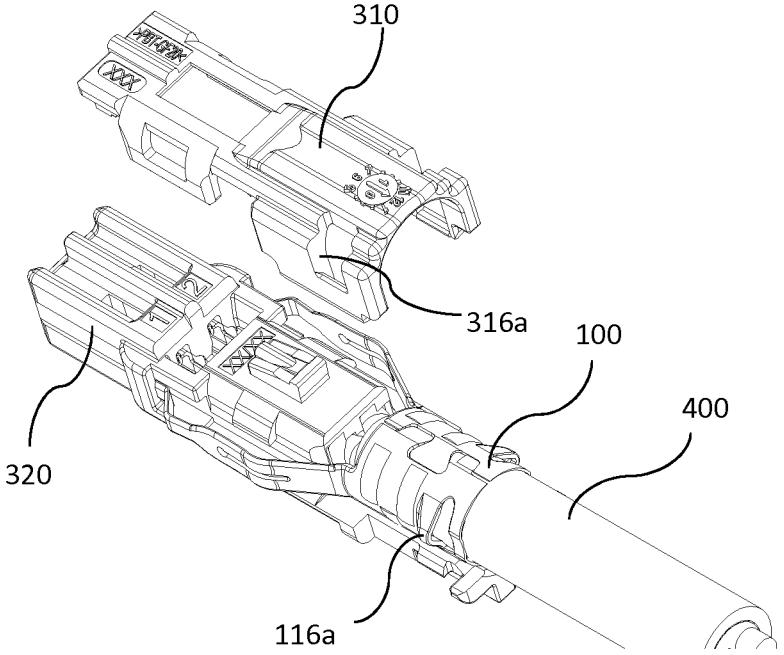
Figure 4L:
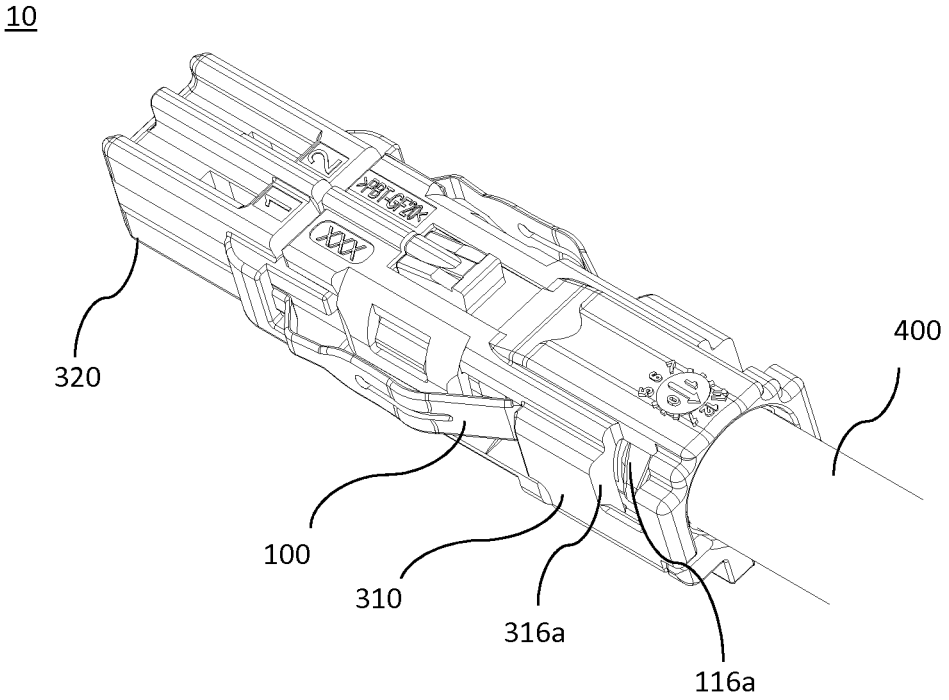

As shown in FIG. 4J, the cable 400 with the electrical shielding member 100 is arranged within the second housing part 320. The, the first housing part 310 is assembled and latched to the second housing part 320 (see FIGS. 4K and 4L). The coupling elements 116*a* and 116*b* couple with the corresponding coupling elements 316*a* and 316*b* of the first housing part 310. The corresponding coupling elements 316*a* and 316*b* are provided as coupling openings. A cut face of the coupling elements 116*a*, 116*b* can abut with the corresponding face of the counter coupling elements 316*a*, 316*b* to secure the electrical shielding member 100 within the housing 300. FIG. 4L shows the network connector 10 in an assembled condition.

Figure 5:
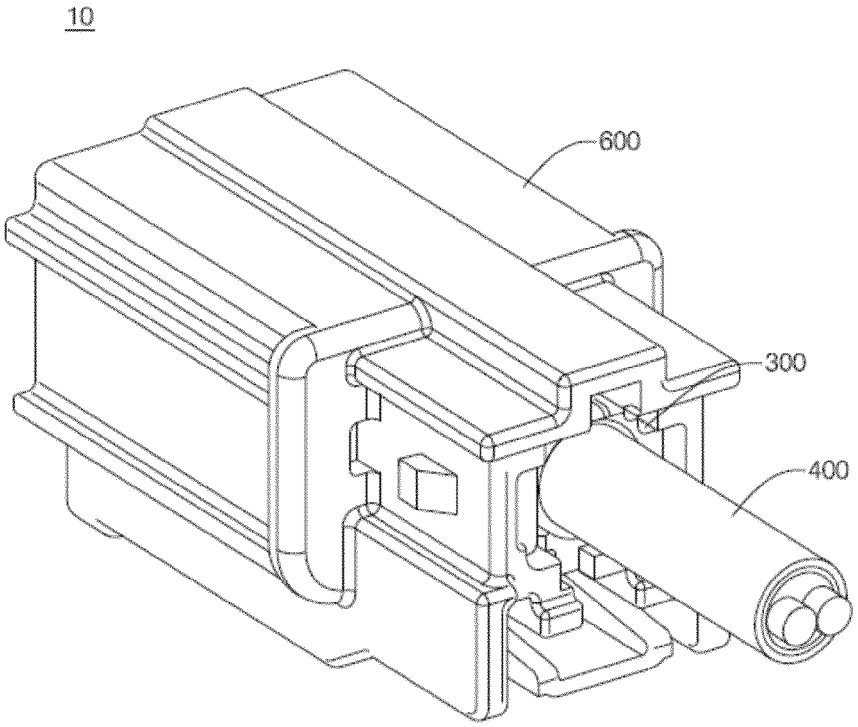
FIG. 5 shows a perspective schematic view of the network connector, being provided in a collector housing.

FIG. 5 shows a perspective schematic view of the network connector 10, being provided in a collector housing 600. The collector housing 600 covers the network connector 10 and protects the electrical conductive parts, such as the electrical contact terminals 530, 540 and the electrical shielding member 100 form mechanical impact. Particularly, the electrical conductive parts are protected from being touched, i.e. they are provided fully finger proof within the collector housing 600.

Figure 6:
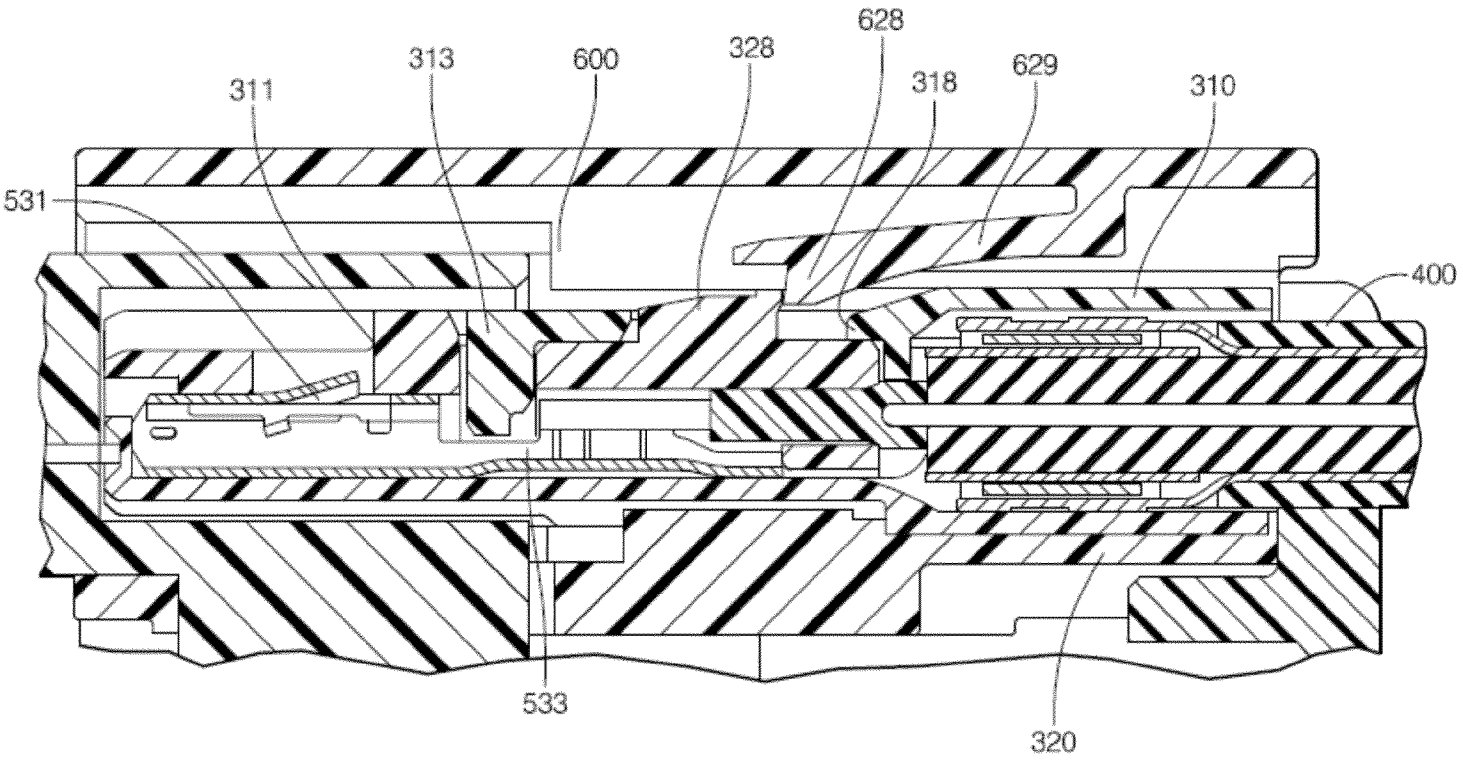
FIG. 6 shows a schematic cut view of an assembled network connector, as shown in FIG. 5.

FIG. 6 shows a schematic cut view of an assembled network connector, as shown in FIG. 5. The electrical contact terminal 530 may have a primary locking means 531 and the connector housing may have a corresponding primary locking means 311, that engage with each other when the terminal 530 is assembled. Further, the electrical contact terminal 530 may have a secondary locking means 533 and the connector housing may have a corresponding secondary locking means 313, that engage with each other when the terminal is assembled.

The primary locking means 531, the corresponding primary locking means 311, the secondary locking means 533, the corresponding secondary locking means 313 and the coupling element 116 *a*, 116*b* and the counter coupling element 316*a*, 316*b* may be arranged so that, when pulling the cable 400 out of the connector housing 300, firstly the primary locking means 531 and the corresponding primary locking means 311 abut each other. Subsequently, the coupling element 116 *a*, 116*b* and the counter coupling element 316*a*, 316*b* may abut each other and thereafter, the secondary locking means 533 and the corresponding secondary locking means 313 may abut each other. Thus, the cable 400 can be held reliable with in the connector housing 300, without losing its electrical connection.

The primary locking means 531, 541 of the electrical contact terminals may be provided as latching arms and the secondary locking means 533, 543 may be provided as locking recess that receives a corresponding secondary locking means 313 of the connector housing 300. Further, the corresponding coupling protrusion 328 of the second housing part 320 may protrude through an opening of the first housing part, which serves as coupling opening 318. This allows the coupling protrusion 328 to couple with a corresponding coupling protrusion 628 of collector housing 600. The corresponding coupling protrusion 628 of collector housing 600 may be provided on a latching arm 629 to provide a releasable coupling of the collector housing 600 and the connector housing 300.

Figure 7:
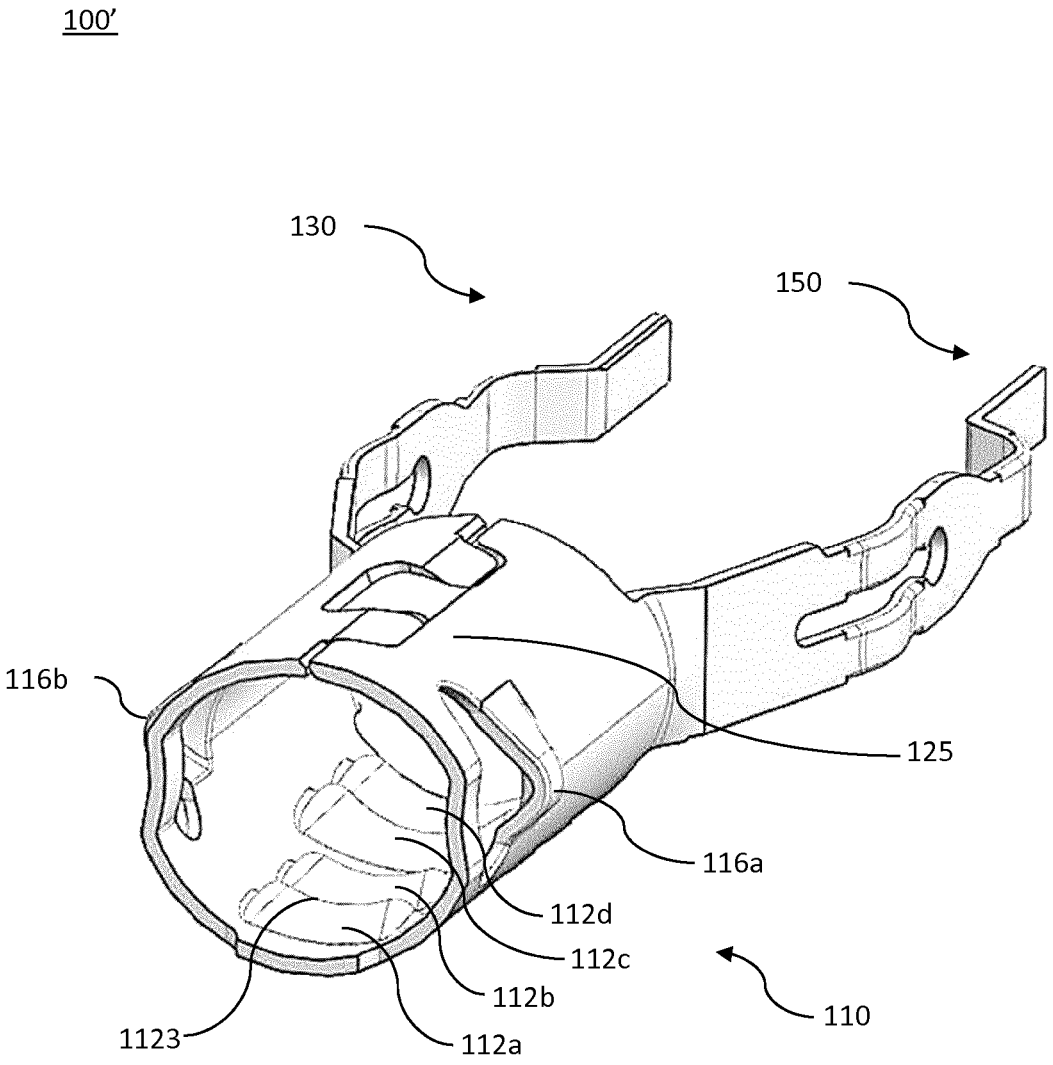
FIG. 7 shows a perspective schematic view of a further electrical shielding element.

FIG. 7 shows an electrical shielding member 100' that has particularly the same structure as the electrical shielding member 100, shown in FIG. 1. Thus, the parts of the electrical shielding member that are already described with respect to FIG. 1, can also be present in the electrical shielding member 100' and are not described here explicitly. The embodiment shown in FIG. 7 is not provided with secondary fastening elements 117. However, providing secondary fastening elements is possible.

The electrical shielding member 100' comprises multiple engagement elements 112*a*, 112*b*, 112*c* and 112*d*. The engagement elements 112*a*, 112*b*, 112*c* and 112*d* are arranged so that at least a first engagement element 112*a* is engaged with the cable, in particular with a cable jacket. Second engagement elements 112*b*, 112*c* and 112*d* are arranged so as to be engaged with a fastening ferrule (inner ferrule) of the cable, as shown in greater detail in FIG. 8. Providing multiple engagement elements allows for increased retention forces of the cable. The engagement elements 112*a*, 112*b*, 112*c* and 112*d* may have different widths and/or heights to provide the desired retention force.

Figure 8:
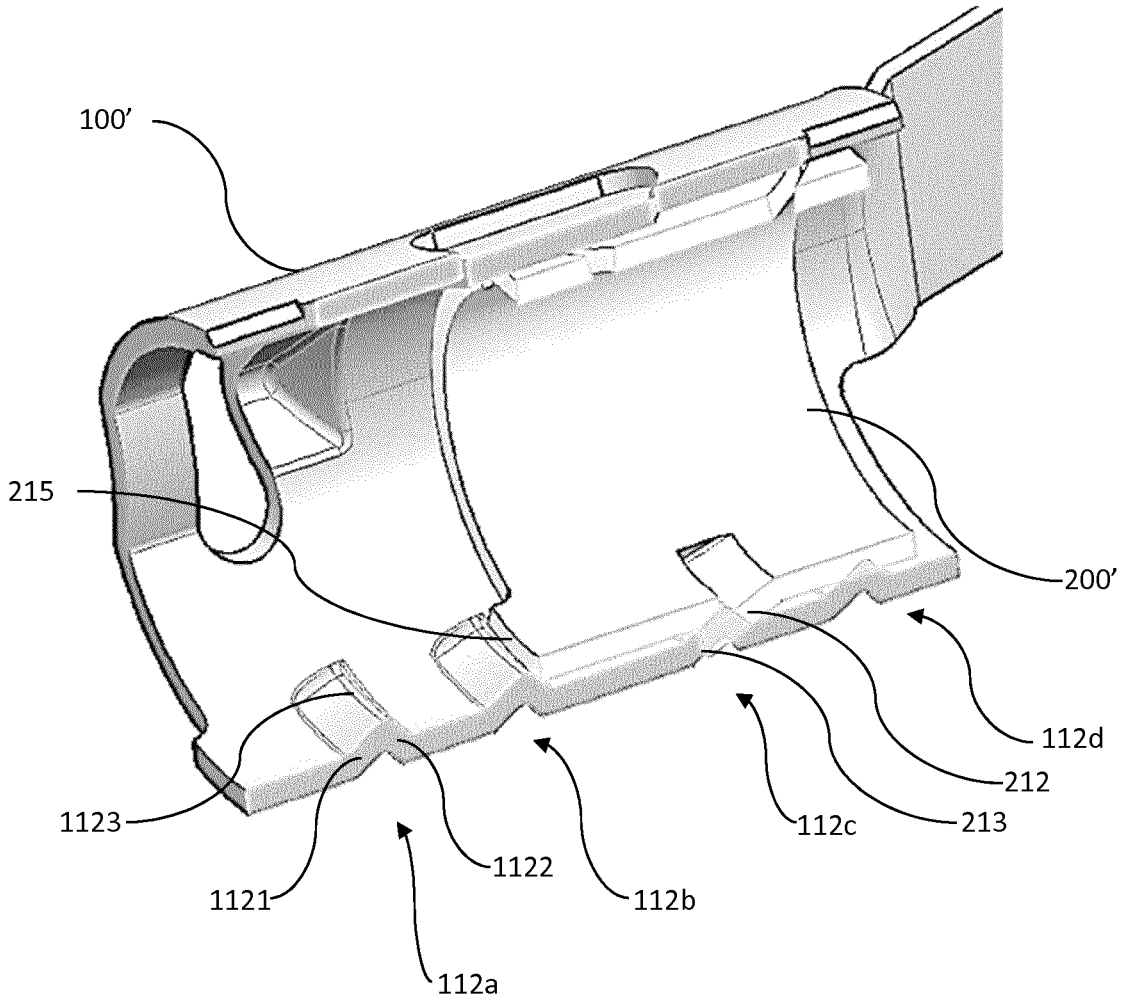
FIG. 8 shows a detailed cut view of an electrical shielding assembly.

FIG. 8 shows a detailed cut view of an electrical shielding assembly, comprising an inner ferrule 200', that is adapted to be crimped on a stripped cable end of a shielded cable (not shown) and an outer ferrule, wherein the outer ferule is an electrical shielding member 100', as described above. Even though FIG. 8 shows an electrical shielding assembly that comprises inner ferrule 200' and electrical shielding member 100', other embodiments may comprise the electrical shielding member 100 and/or the inner ferrule 200 as depicted in FIGS. 1 to 2B.

The inner ferrule 200' comprises a corresponding engagement element 212 that protrudes outwardly from the inner ferrule 200', wherein the corresponding engagement element 212 is engaged with an engagement element 112*c* of the electrical shielding member 100'.

The corresponding engagement element 212 of the inner ferrule 200' is formed as embossed element, and comprises a perforated section 213, wherein the perforated section 213 comprises a cut edge, that intersects the longitudinal direction of the cable to be received under an angle of about 90°. The cut edge provides a secure engagement between the corresponding engagement element 212 of the inner ferrule 200' and the engagement element 112*c* of the electrical shielding member 100'.

The inner ferrule 200' further comprises an abutment face 215 that is arranged on a front face of the inner ferrule 200'. The abutment face 215 faces into the opposite direction of the cable end, when the inner ferrule 200' is arranged on the stripped cable end. Said abutment face 215 is engaged with the engagement element 112*b* of the electrical shielding member 100'.

The engagement elements 112*a*, 112*b*, 112*c* and 112*d* are provided in the embodiment shown in FIG. 8 as embossed elements (embossed ribs). Each engagement element comprises a first shoulder 1121 and a second shoulder 1122, wherein the first and second shoulders 1121, 1122 form an edge 1123 that protrudes inwardly into the receiving portion of the electrical shielding member 100'. The edge 1123 intersects the longitudinal direction of the cable to be received under an angle of about 90°. The second shoulder 1122 of engagement element 112*c* engages with the corresponding engagement element 212 of the inner ferrule 200'.

The first shoulder 1121 encloses an acute angle with an inner surface of the receiving portion of the electrical shielding member 100'. Further, the first shoulder 1121 and the second shoulder 1122 enclose an angle of about 90°, wherein the second shoulder 1122 faces into the direction of the cable end, when the cable end is received within the receiving portion of the electrical shielding member 100'. This configuration allows to provide high retention forces with low tolerances.

LIST OF REFERENCE SIGNS

10 network connector
100, 100' electrical shielding member
110 receiving portion
112 engagement element
112*a, b* engagement element
112*c, d* engagement element
1121 first shoulder
1122 second shoulder
1123 edge
113 perforated section
114*a, b* primary fastening element
115*a, b* lateral trough-opening
116*a, b* coupling element
117 secondary fastening element
122 primary locking protrusion
123 primary locking recess
124, 126 secondary locking protrusion
125, 127 secondary locking recess
130, 150 contact beam
131, 132, 133 contact points
151, 152, 153 contact points
200, 200' inner (fastening) ferrule
212 corresponding engagement element
213 perforated section of corresponding engagement element
215 abutment face
222 locking protrusion
223 locking recess
230 engagement protrusion
300 network connector housing
310 first housing part
311 corresponding primary locking means
312 primary latching arm
313 corresponding secondary locking means

314 secondary latching arm
316*a, b* counter coupling element
318 coupling opening
320 second housing part
322 primary latching element
324 secondary latching element
327 stopping member
328 coupling protrusion
400 cable
410 shielding
430 wire
440 wire
530 electrical contact terminal
531 primary locking means
533 secondary locking means
540 electrical contact terminal
541 primary locking means
543 secondary locking means
600 collector housing
628 corresponding coupling protrusion of collector housing

The invention claimed is:

1. An electrical shielding member for a network connector, wherein the electrical shielding member is made from bent and cut sheet metal, the electrical shielding member comprising:

a receiving portion having an interior space for receiving a cable end of a shielded cable at least partially, wherein the receiving portion is adapted to be in contact with a shielding of the cable, and wherein the receiving portion comprises:

at least one coupling element, protruding outwardly from the receiving portion, wherein the coupling element is adapted to be coupled to a corresponding coupling element of a network connector housing, and wherein the coupling element is a coupling protrusion, embossed in the receiving portion; and an engagement element, protruding inwardly into the interior space of the receiving portion, wherein the engagement element is adapted to be engaged with the cable and/or a fastening ferrule of the cable, the electrical shielding member further comprising:

at least one contact beam, extending from the receiving portion, wherein the contact beam is adapted to be electrically connected to a counter electrical shielding member of a counter connector.

2. The electrical shielding member claim 1, wherein the electrical shielding member comprises multiple engagement elements.

3. The electrical shielding member of claim 2, wherein at least two of the engagement elements have a different width in a direction perpendicular to the longitudinal direction of the cable.

4. The electrical shielding member of claim 1, wherein at least one engagement element is an embossed element, comprising a perforated section, wherein the perforated section further comprises:

a cut edge, that intersects the longitudinal direction of the cable to be received under an angle of about 90°, and a cut face that faces into the direction of the cable end, when the cable end is received within the receiving portion.

5. The electrical shielding member of claim 1, wherein at least one engagement element is an embossed element, that comprises a first shoulder and a second shoulder, wherein the first and second shoulders form an edge that protrudes inwardly into the receiving portion and that intersects the longitudinal direction of the cable to be received under an angle of about 90°.

6. The electrical shielding member of claim 5, wherein the first shoulder encloses an acute angle with an inner surface of the receiving portion, and wherein the first shoulder and the second shoulder enclose an angle in the range of 75° to 105°, wherein the second shoulder faces into the direction of the cable end, when the cable end is received within the receiving portion.

7. The electrical shielding member of claim 1, wherein the coupling element comprises a cut face that faces away from the cable end, when the cable end is received within the receiving portion.

8. The electrical shielding member of claim 1, wherein at least three sides of the coupling element are connected with the receiving portion.

9. The electrical shielding member of claim 1, wherein the electrical shielding member further comprises at least two coupling elements, and wherein the coupling elements are preferably equally distributed around a circumference of the receiving portion of the electrical shielding member.

10. The electrical shielding member of claim 1, wherein the receiving portion comprises opposing joint rims, wherein a first joint rim is provided a primary locking protrusion and the second joint rim is provided with a corresponding primary locking recess, and wherein the first joint rim is preferably provided with at least one secondary locking recess and the second joint rim is provided with at least one corresponding secondary locking protrusion.

11. The electrical shielding member of claim 1, further comprising at least one primary fastening element, wherein the primary fastening element protrudes inwardly into the receiving portion and is provided an end of the receiving portion that faces away from the cable end, in an assembled state, and wherein the electrical shielding member further comprises a lateral trough-opening, adjacent to the primary fastening element.

12. The electrical shielding member of claim 1, further comprising a secondary fastening element, wherein the secondary fastening element protrudes inwardly into the receiving portion and is provided at a distal end of the receiving portion that faces into the direction of the cable end, in an assembled state.

13. An electrical shielding assembly for a network connector, the electrical shielding assembly comprising an inner ferrule, that is adapted to be crimped on a stripped cable end of a shielded cable to be in electrical contact with a shielding of the cable, and an outer ferrule, wherein the outer ferrule is an electrical shielding member and is adapted to be crimped over the inner ferrule, so that the inner ferrule is at least partially received within an interior space of a receiving portion of the electrical shielding member;

at least one corresponding engagement element that protrudes outwardly from the inner ferrule, wherein the corresponding engagement element is adapted to be engaged with an engagement element of the electrical shielding member, when the electrical shielding member is crimped over the inner ferrule.

14. The electrical shielding assembly of claim 13, wherein the inner ferrule further comprises a number of engagement protrusions that protrude inwardly into and/or outwardly from the inner ferrule, wherein the engagement protrusions are formed as embossment, piercing, rim hole, and/or a louver or a combination thereof.

15. The electrical shielding assembly of claim 13, wherein the corresponding engagement element of the inner ferrule is formed as an embossed element, and comprises a perforated section, wherein the perforated section further preferably comprises a cut edge, that intersects the longitudinal direction of the cable to be received under an angle of about 90°, and a cut face that even more preferably faces into the opposite direction of the cable end, when the inner ferrule is arranged on the stripped cable end.

16. The electrical shielding assembly of claim 13, wherein the corresponding engagement element of the inner ferrule is an engagement arm, having a free end that faces into the opposite direction of the cable end, when the inner ferrule is arranged on the stripped cable end.

17. The electrical shielding assembly of claim 13, wherein the inner ferrule-further comprises an abutment face arranged on a front face of the inner ferrule that faces into the opposite direction of the cable end, when the inner ferrule is arranged on the stripped cable end, wherein the abutment face is adapted to be engaged with an engagement element of the electrical shielding member, when the electrical shielding member is crimped over the inner ferrule.

* * * * *